United States Patent [19]

Berger

[11] Patent Number: 4,499,912

[45] Date of Patent: Feb. 19, 1985

[54] FREE AIR DILUTION SMOKE FILTER AND METHOD AND APPARATUS FOR FABRICATING SAME

[75] Inventor: Richard M. Berger, Midlothian, Va.

[73] Assignee: American Filtrona Corporation, Richmond, Va.

[21] Appl. No.: 333,815

[22] Filed: Dec. 23, 1981

[51] Int. Cl.[3] ..... A24D 3/04

[52] U.S. Cl. ..... 131/336; 131/341; 131/361

[58] Field of Search ..... 131/336, 361, 340, 341, 131/362, 339, 365, 343, 202, 207

[56] References Cited

U.S. PATENT DOCUMENTS

| | | | |
|---|---|---|---|
| 70,385 | 11/1867 | Alexander | 131/202 |
| 3,470,008 | 9/1969 | Watson | 131/343 |
| 3,910,288 | 8/1975 | Hammersmith et al. | 131/340 |
| 4,201,232 | 5/1980 | Kaye | 131/341 |
| 4,338,956 | 7/1982 | Sanford et al. | 131/361 |
| 4,365,641 | 12/1982 | Johnson | 131/339 |
| 4,387,728 | 6/1983 | Reynolds et al. | 131/361 |

FOREIGN PATENT DOCUMENTS

| | | | |
|---|---|---|---|
| 1249139 | 8/1967 | Fed. Rep. of Germany | 131/207 |
| 1532170 | 1/1970 | Fed. Rep. of Germany | 131/207 |

*Primary Examiner*—V. Millin
*Assistant Examiner*—Harry Macey
*Attorney, Agent, or Firm*—Holman & Stern

[57] ABSTRACT

An improved tobacco smoke filter is characterized by grooves defined in its outer periphery and extending to the smoke discharging end of the filter. The grooves are totally exposed to ambient air along their entire length and serve as open air dilution passages to conduct air into the smoker's mouth with each puff or draw. In one embodiment, the filter rod contains no plug wrap and is joined to a tobacco rod with tipping paper, the grooves being defined in both the tipping paper and the filter rod. These grooves may be defined in the final assembled product by forming the grooves in the tipping paper and the filter rod at the same time. Alternatively, the filter rod is pre-grooved and the tipping paper is attached thereto so as to conform to the grooves. In another embodiment, the filter rod is wrapped with a suitable plug wrap which is either grooved simultaneously with the rod or applied to conform to the pre-grooved rod; a short tipping paper ring is then applied to the joint between the filter rod and the tobacco rod.

14 Claims, 11 Drawing Figures

FREE AIR DILUTION SMOKE FILTER AND METHOD AND APPARATUS FOR FABRICATING SAME

TECHNICAL FIELD

The present invention relates to filter elements and the fabrication of such filter elements. More particularly, the present invention relates to an improved air dilution tobacco smoke filter. Although the present invention is primarily concerned with producing filter means for cigarettes, it should be noted that the products of the present invention are generally useful as filters for any tobacco smoking means, whether they be cigarettes, cigars, pipes, etc. Since filters for cigarettes have particular commercial importance, the embodiments described herein relate to the production of filtered cigarettes.

BACKGROUND OF THE INVENTION

In fabricating filters for use in connection with cigarettes and the like, a number of different properties of the resultant filter must be taken into consideration. While filtration efficiency (i.e., the ability of the filter to remove undesirable constituents from tobacco smoke) is perhaps the most important property of cigarette filters, filtration efficiency must frequently be comprimsed in order for the filter to possess a commercially acceptable combination of other properties, including pressure drop, taste, hardness, appearance, and cost. For example, the most commonly utilized cellulose acetate filter has a relatively low filtration efficiency since increased efficiency can only be obtained either by increasing the density of the filter material or the length of the element, both of which produce a pressure drop across the filter which is excessive and unacceptable from a commercial standpoint.

In recent years, air dilution has become a popular technique for compensating for the relatively low filtration efficiency of cigarette filters having a sufficiently low pressure drop for commercial acceptance. The air diluation technique employs air to dilute the smoke stream from the cigarette and thereby reduce the quantity of tar and other undesirable tobacco smoke constituents drawn into the smoker's mouth for each puff or draw. The air is generally provided through a plurality of perforations at the tipping paper employed for joining the filter to the tobacco column of the cigarette, and if the filter is overwrapped with plug wrap paper, an air pervious plug wrap paper is employed. Alternatively, air-impervious plug wrap paper may be employed and grooves formed in the air impervious plug wrap paper to provide passages of air to the smoker's mouth.

The demand for low tar cigarettes has become a major portion of the cigarette business and, therefore, the air dilution technique has become a primarily important approach in achieving low tar levels. As noted above, however, all prior art air dilution filters employ either perforated air-impervious tipping paper or porous tipping paper to permit air to flow through the tipping paper and either into the main smoke stream or along a groove defined in the rod periphery. In these prior art air dilution filters, the ultimate control of tar delivery is dependent upon the uniformity of the perforation in the tipping paper or the porousity of porous tipping paper should that be used. It is desirable to eliminate this dependence upon the characteristics of the tipping paper.

SUMMARY OF THE INVENTION

It a primary object of the present invention to provide a cigarette and/or cigarette filter wherein air dilution can be accurately controlled without dependence upon porous tipping paper or perforated tipping paper.

It is an other object of the present invention to provide a low cost approach to filtering cigarettes with the air dilution technique.

It is still another object of the present invention to provide an inexpensive air dilution smoke filter without the use of porous tipping paper or tipping paper having prescribed ventilation holes defined therein.

In accordance with the present invention, grooves are defined in the periphery of the filter and are maintained open to ambient along their length. These open grooves extend to the smoke discharging end of the filter and therefore deliver air into the smoker's mouth with each puff. In one embodiment, the grooves are defined in the filter rod and the tipping paper. In this embodiment, the filter rod can be pre-grooved and the tipping paper applied using a vacuum system which causes the tipping paper to conform to the pre-grooved filter configurations; alternatively, the tipping paper can be applied to the filter and cigarette, after which the grooves are formed in the filter and tipping paper simultaneously. In a second embodiment, an air-impervious plug wrap is employed and the grooves may be formed in the plug wrap and filter simultaneously, or the plug wrap may be applied by a vacuum application technique whereby the plug wrap conforms to the pre-grooved filter rod. This second embodiment employs only a ring of tipping paper to secure the filter to the cigarette at the junction between the filter rod and the tobacco rod.

BRIEF DESCRIPTION OF THE DRAWINGS

The above and still further objects, features, and advantages of the present invention will become apparent upon consideration of the following detailed description of the specific embodiments thereof, especially when taken in conjunction with the accompanying drawings, wherein.

DESCRIPTION OF THE PREFERRED EMBODIMENT

Figure 1:
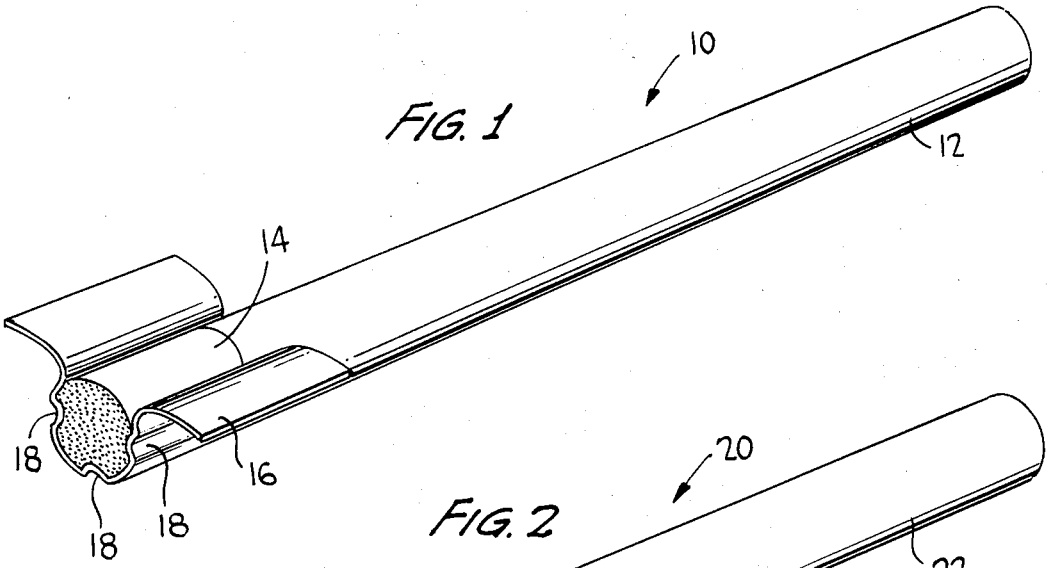
FIG. 1 is a view in perspective of one form of cigarette produced in accordance with the present invention, the tipping paper being partially torn away for illustrative clarity.

Referring to the drawings with greater specificity, and particularly to FIG. 1, a filtered cigarette according to the present invention is generally designated by the reference numeral 10. Cigarette 10 includes a tobacco rod 12 and a filter element 14 constructed in accordance with one embodiment of the present invention. A tipping overwrap 16 secures the tobacco rod 12 and filter element 14 in end-to-end relationship in accordance with well known techniques in this field. Filter 14 is a generally cylindrical plug of conventional tobacco smoke filter material and typically is made from continuous tow of cellulose acetate filamentary material; it should be noted, however, that other filtering material may be employed with slight modifications. For example, filamentary tow formed of other materials such as polyethylene, polypropylene, and the like, or even nonwoven staple fibers may be used. It should be understood, however, that cellulose acetate filamentary tow is the preferred material from a commercial standpoint. In this sense, filter plug 14 is fabricated from conventional material to function as a smoke-pervious filter plug for trapping solid particulates in the smoke passing therethrough.

Unlike many conventional air dilution filters, filter plug 14 is not circumscribed by a non-porous or smoke-impervious plug wrap between the plug and tipping paper 16. Rather, the air-impervious tipping paper 16 is applied directly to the plug 14 and a portion of tobacco rod 12. Tipping paper 16 circumscribes filter plug 14 along the entire length of the plug. There are no ventilation holes provided in tipping paper 16 so that ambient air cannot enter the filter plug through the tipping paper 16 nor can smoke from the plug 14 egress through the tipping paper. The tipping paper 16, in addition to securing the smoke receiving end of plug 14 to one end of tobacco rod 12 in concentric end-to-end relation, also serves to conduct ambient air into the smoker's mouth which each puff on the cigarette. Specifically, the diagrammatic representation of plug 14 in FIG. 1 shows the tipping paper 16 partially torn away. This is to represent the fact that the plug 14, for the embodiment of FIG. 1, is not grooved prior to application of the tipping paper thereto. In other words, a plurality of grooves 18 are defined longitudinally in both the tipping paper 16 and plug 14, but are defined after the tipping paper is applied and the complete cigarette assembled. Grooves 18 are open to ambient along their entire length and extend from a predetermined point along the length of plug 14 to the smoke discharging end of the filter. In other words, after the cigarette has been made and cut, grooves are placed in the outside of the tipping paper, to a depth in plug 14, in accordance with the exact amount of dilution desired. The number of angularly spaced grooves 14 is also determined by the amount of dilution desired. As noted, the grooves extend from the smoke discharging end of the filter to a length sufficient so that the smoker's lips will not normally extend longitudinally beyond the length of the grooves. For example, the grooves can extend the entire length of plug or rod 14, or some shorter distance, as desired. Thus, the cigarette 10 of FIG. 1 can be fabricated by any conventional method and apparatus and, after it is fabricated, passed through a crimping mechanism to form grooves 18, as desired.

It is important to note that the grooves 18, rather than being covered so that access is provided through a porous material or through ventilation holes, is open along its entire length. Since the grooves are recessed with respect to the outer periphery of the tipping paper, the grooves provide passages through the lips of the smoker which engage the outer periphery of tipping paper 16. These passages conduct air into the mouth of the smoker with each puff or draw at the smoke discharging end of the filter. The absence of barriers or restrictions to the flow reduces flow impedance as compared to prior art dilution filters and thereby permits better control of the air dilution technique. In addition, since the plug wrap normally disposed between the tipping paper and the filter rod is eliminated, the cigarette 10 is simpler and less costly to manufacture.

As described, in the fabrication of cigarette 10 of FIG. 1, the grooves 18 are formed simultaneously in filter rod 14 and tipping paper 16. In cigarette 20, illustrated in FIG. 2, filter rod 24 is pre-grooved with grooves 28 before application of the tipping paper 26 to secure tobacco 22 to the filter rod. In order to assure that the tipping paper 26 conforms to the grooves 28 in the filter rod, a vacuum system is employed as part of the tipping wrap machine to draw a vacuum upon the completed cigarette before the adhesive has dried. In this manner, the tipping paper is forced to conform to the pre-grooved periphery of filter rod 24. With respect to the appearance of the final product to the naked eye, cigarettes 10 and 20 appear identical. Cigarette 20 functions in the same manner as cigarette 10 so that the grooves 28, to which tipping paper 26 conforms, conduct air directly into the mouth of the smoker with each puff along with smoke filtered through rod 24.

Figure 2:
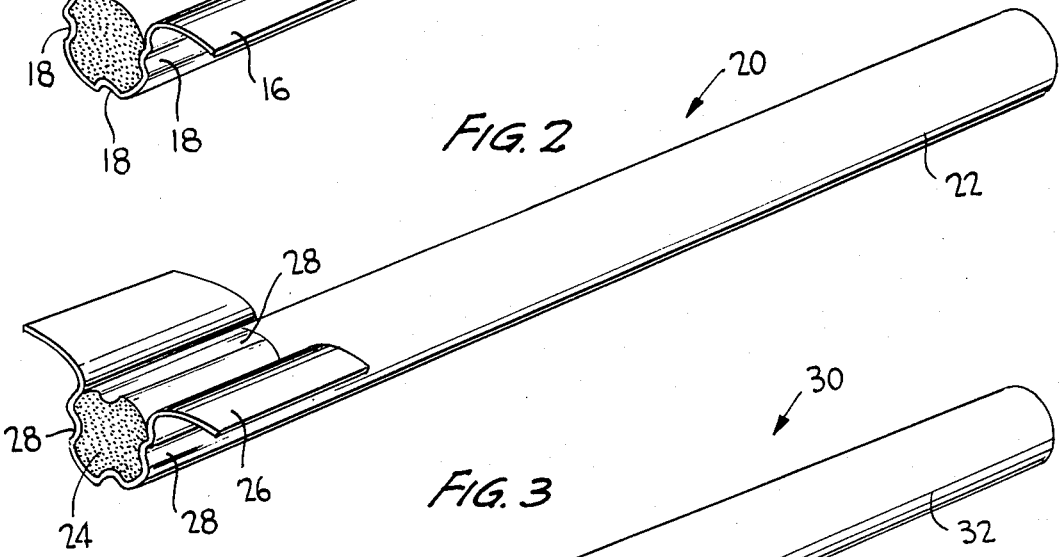
FIG. 2 is a view similar to that of FIG. 1 but illustrating a second form a cigarette produced in accordance with the present invention.
Figure 3:
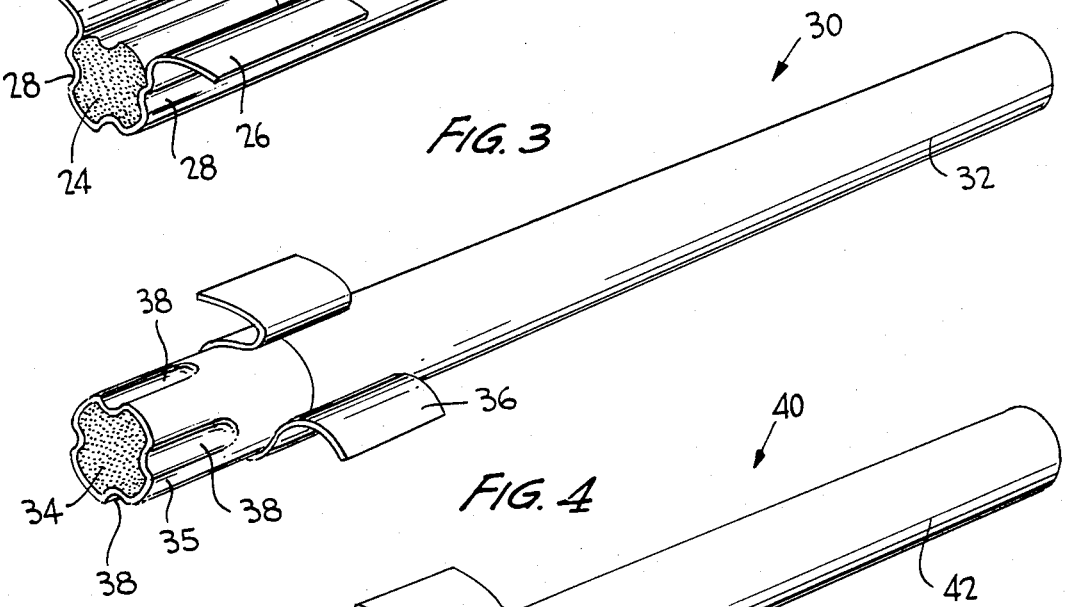
FIG. 3 is a view similar to that of FIG. 1 but illustrating a third form of cigarettes produced in accordance with the present invention.

Another cigarette embodiment 30 of the present invention is illustrated in FIG. 3. Tobacco rod 32 is secured in end-to-end relation with filter rod 34 as in the embodiments of FIGS. 1 and 2. However, filter rod 34 is circumscribed along its entire length by a non-porous or smoke-impervious plug wrap 35. It will be recognized by those familiar with this art that the smoke-impervious plug wrap includes smoke-impervious outer surfaces of foamed material which are integral with the filter plug as well as smoke-impervious wrapping material, which is not integral with the filter plug. Plural grooves 38 are defined in the plug wrap 35 and plug 34 and take the form of recesses having their depth dimension extending radially inward from plug 34 and their length dimension extending from the smoke discharging end to a length sufficient to avoid the entire length of grooves 38 being disposed in a smoker's mouth during use. A ring of tipping paper 36 is disposed about the junction between the filter rod 34 and tobacco rod 32 to join the two rods together. Tipping paper 36 differs from tipping paper 26 and tipping paper 16 in that it is much shorter in axial length and is not grooved. Rather, the grooves 38 are defined in the smoke-impervious plug wrap 35 and extend into the filter 34, as described. Air dilution is effected in cigarette 30 in the same manner described above for cigarettes 10 and 20 of FIGS. 1 and 2, respectively. Specifically, grooves 38 in the plug wrap 34 are exposed to ambient and provides passages passed the smoker's lips and into the smoker's mouth. Ambient air is therefore drawn into the smoker's mouth with each draw or puff so that the ambient air enters in parallel to the filtered smoke passing through the smoke discharging end of the filter and into the smoker's mouth.

Although cigarette 30 employs a plug wrap whereas the plug wrap is eliminated in cigarettes 10 and 20, the savings on the amount of tipping paper employed may, in some cases, make up the difference in cost. Moreover, since normal tipping paper is placed directly in the mouth, the requirements therefor are considerably more stringent than would be the case in the simple ring tipping paper application for cigarette 30. In other words, less expensive material can be used for tipping paper 36 and for tipping papes 16 and 26.

Figure 4:
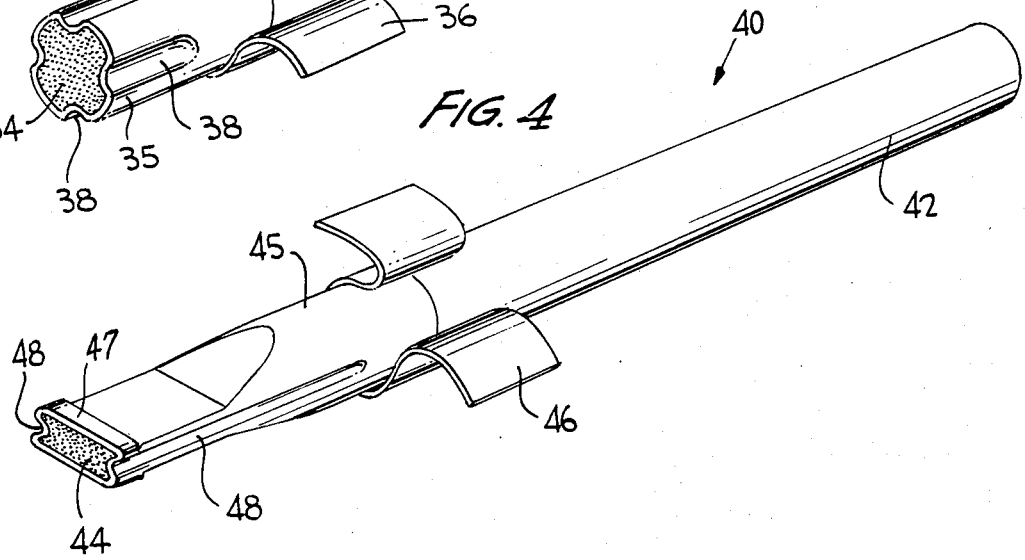
FIG. 4 is a view similar to that of FIG. 1 but illustrating a fourth form of the cigarette produced in accordance with the present invention.

Referring now to FIG. 4 of the accompany drawings, another cigarette embodiment 40 is illustrated in accordance with the present invention. Like cigarette 30, a tobacco rod 42 is joined to a filter rod 44 which has plug wrap material 45 circumscribing its entire length. A ring of tipping papers 46 covers only a short length of both the filter rod and tobacco rod to join the two end-to-end in concentric relation. Filter rod 44 and plug wrap 45 are contoured to the shape of a cigarette holder in the manner described in my copending U.S. patent application Ser. No. 333,802, filed simultaneously herewith, and entitled "Improved Tobacco Smoke Filter Contoured To Provide Undiluted Air Flow And Method And Apparatus For Manufacturing Same". Specifically, the generally cylindrical filter rod 44 remains generally cylindrical from its smoke receiving end to a location axially displaced therefrom and then is tapered to form a generally rectangular cross-section. A raised lip 47 at the smoke discharging end, also having a rectangular cross-section fits the smoker's lips to provide a cigarette holding function. Grooves 48 are defined longitudinally along the filter 44, into the plug wrap 45 and filter rod 44. In the case of the embodiment illustrated, wherein the rectangular cross-section of the filter near the smoke discharging end has two long sides and two short sides, the grooves 48 are defined in the short sides. It should be noted, however, that a square configuration may also be provided in which case the grooves would be provided in all four (4) sides.

The grooved filter 44 and plug wrap 45 may be fabricated in the manner described in aforementioned U.S. patent application Ser. No. 06/333,802, now U.S. Pat. No. 4,423,744, by any of the two (2 ) methods described therein. Specifically, a first described in that U.S. patent application Ser. No. 06/333,802, now U.S. Pat. No. 4,423,744, particularly with respect to FIGS. 9–13, forms the cigarette holder shape and the grooves 48 in the filter rod 44 after it is wrapped with plug wrap 45. Alternatively, as described in relation to FIGS. 14 and 15 of my aforementioned U.S. patent application Ser. No. 06/333,802, now U.S. Pat. No. 4,423,744, the filter rod 44 may be pre-shaped and pre-grooved and the plug wrap extruded thereover in the form of a plastic film which conforms precisely to the tapered and grooved periphery of the filter rod. In either case, the operation of the filter 40 is substantially the same as the filters described in relation to FIGS. 1–3. In other words, groove 48 is exposed to ambient air and provides a passage for that air into the smoker's mouth, past the smoker's lips. With each puff or draw on the cigarette, the smoker draws in filtered smoke from the smoke discharging end of filter 44 and ambient air via grooves 48.

Figure 5:
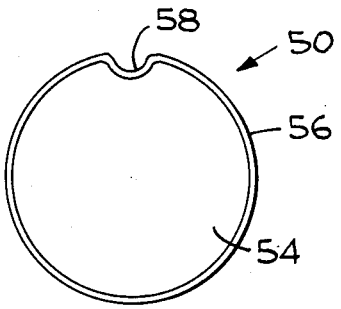
FIGS. 5, 6, 7, 8, 9, 10, and 11 are different possible end views of cigarettes of the forms illustrated in FIGS. 1, 2, and 3, showing the different number of grooves which can be provided in the outer periphery of the filter.

FIGS. 5–11 illustrate end views of various grooved filters in accordance with FIGS. 1–3. These views are provided to show that substantially any number of grooves, with substantially any spacing therebetween, may be provided. For example, cigarette 50 of FIG. 5 shows filter rod 54 and tipping paper 56 provided with a single groove 58 at the smoke discharging end of the filter. Of course, if cigarette 50 is made in accordance with the principals of cigarette 30 of FIG. 3, element 56 would, instead of being tipping paper, by plug wrap material.

Figure 6:
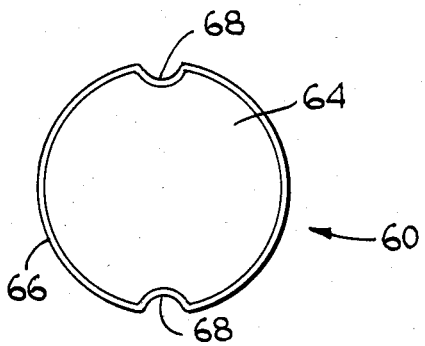

Likewise, cigarette 60 of FIG. 6 shows filter 64 and tipping paper 66 provided with two diametrically spaced grooves or recesses 68.

Figure 7:
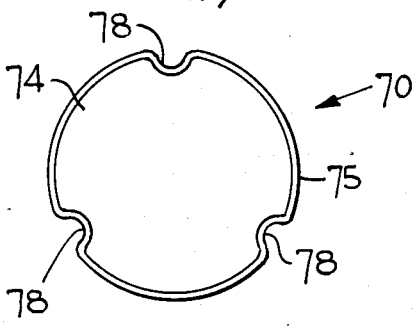

Cigarette 70 of FIG. 7 shows plug wrap 75 and filter rod 74 provided with three equally spaced grooves or recesses 78.

Figure 8:
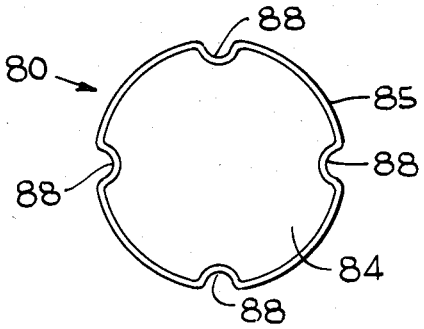

Cigarette 80 of FIG. 8 has filter rod 84 and plug wrap 85 provided with four 90°-spaced recesses or grooves 88.

Figure 9:
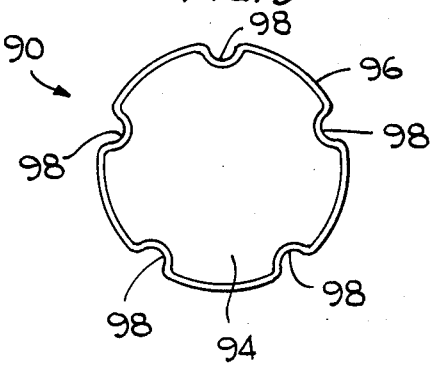

Cigarette 90 of FIG. 9 shows tipping paper 96 and filter rod 94 provided with five equally spaced recesses or grooves 98.

Figure 10:
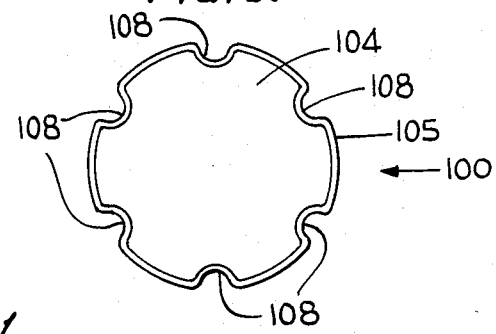

Cigarette 100 of FIG. 10 shows plug wrap 105 and filter rod 104 provided with six equally spaced grooves or recesses 108.

Figure 11:
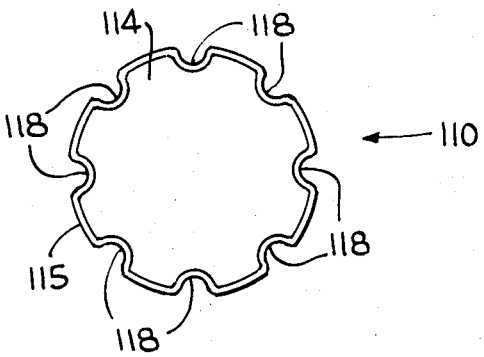

Cigarette 110 of FIG. 11 illustrates filter rod 114 and tipping paper 116 provided with eight equally spaced grooves or recesses 118. It should be noted that equal spacing between the grooves or recesses in any of the embodiments is not necessary; that is, the grooves or recesses can be grouped or spaced as desired around the periphery of the filter rod. Moreover, it is not mandatory, although simpler to fabricate, that the recesses or grooves extend longitudinally parallel to the axis of the filter rod. In other words, the recesses can be skewed relative to the filter rod axis, spiraled, etc.

For all of the filtered cigarettes described hereinabove, the most important aspect is the fact that the air ventilation passage is exposed to ambient throughout its length so that air does not have to pass through porous tipping paper or restricted ventilation openings in nonporous paper. The unimpeded air flow into the smoker's mouth with each draw or puff permits accurate control over the air dilution to a degree not possible in the prior art devices. Since the air passage is open to ambient along its entire length, the filter rod requires only one wrap along its entire length, whether the wrap be the plug wrap or the tipping paper. When the plug wrap is used, only a short axial length of tipping paper is required to join the filter plug to the tobacco rod. The result is a cigarette which is simpler and less expensive to manufacture than prior art air dilution filtered cigarettes.

For purposes of describing the method and apparatus for manufacturing the cigarettes of the present invention, the following are expressly incorporated herein by reference: (1) my U.S. patent application Ser. No. 261,690, filed May 07, 1981; and (2) my U.S. patent application Ser. No. 06/333,802, filed Dec. 23, 1981, now U.S. Pat. No. 4,423,744.

While I have described and illustrated specific embodiments of my invention, it will be clear that variations of the details of construction which are specifically illustrated and described may be resorted to without departing from the true spirit and scope of the invention as defined in the appended claims.

I claim:

1. A smoke filter comprising:

a smoker-pervious filter rod having a smoke receiving end and a smoke discharging end; and smoke-impervious wrap means wrapped about and circumscribing said rod along its entire length;

wherein at least one groove is defined in said rod and said wrap means, said groove having a depth dimension extending radially inward of said rod and a length dimension which extends a predetermined distance along said rod from said smoke discharging end of said rod, said groove being open to ambient air along its entire length;

wherein said filter is contoured in the form of a cigarette holder with a raised lip in said smoke discharging end.

2. The smoke filter according to claim 1, wherein said smoke filter is generally cylindrical proximate said smoke receiving end and is flattened to a generally rectangular cross-section having long and short sides proximate said smoke discharging end, and wherein said groove extends longitudinally along at least one of said short sides.

3. The smoke filter according to claim 2, wherein a plurality of grooves, substantially the same as said at least one groove, are defined in said filter rod and wrap means at angularly spaced locations from one another.

4. A filtered cigarette comprising:

a smoke-pervious filter rod having a smoke receiving end and a smoke discharging end;

smoke-impervious wrap means wrapped about and circumscribing said rod along its entire length;

wherein at least one groove is defined in said rod and said wrap means, said groove having a depth dimension extending radially inward of said rod and a length dimension which extends a predetermined distance along said rod from said smoke discharging end of said rod, said groove being open to ambient air along its entire length;

a tobacco rod having first and second ends;

and joining means securing said filter rod and tobacco rod in concentric end-to-end relation with said smoke receiving end abutting said first end of said tobacco rod;

wherein said smoke-impervious wrap means and said joining means are one and the same and comprise tipping paper wrapped about the entire length of said filter rod and a portion of the tobacco rod including said first end.

5. The filtered cigarette according to claim 4, wherein a plurality of grooves, substantially the same as said at least one are defined in said filter rod and wrap means at angularly spaced locations from one another.

6. A filtered cigarette comprising:

a smoke-pervious filter rod having a smoke receiving end and a smoke discharging end;

smoke-impervious wrap means wrapped about and circumscribing said rod along its entire length;

wherein at least one groove is defined in said rod and said wrap means, said groove having a depth dimension extending radially inward of said rod and a length dimension which extends a predetermined distance along said rod from said smoke discharging end of said rod, said groove being open to ambient air along its entire length;

a tobacco rod having first and second ends;

and joining means securing said filter rod and tobacco rod in concentric end-to-end relation with said smoke receiving end abutting said first end of said tobacco rod;

wherein said filter rod is countoured in the form of a cigarette holder with a raised lip at said smoke discharging end, and wherein said joining means comprises a ring of tipping paper circumscribing only a portion of said filter rod including said smoke receiving end and a portion of said tobacco rod including said first end.

7. The filtered cigarette according to claim 6, wherein said wrap means is a film of plastic material tightly circumscribing and conforming to said rod.

8. A filtered cigarette comprising:

a mass of smoke-pervious filter material in the form of a cigarette holder having smoke-receiving and smoke-discharging ends;

a tobacco rod having inflow and outflow ends; and means joining said cigarette holder and tobacco rod in end-to-end relation with the smoke-pervious material of said smoke-receiving end of said cigarette holder abutting the outflow end of the tobacco rod;

wherein said cigarette holder is a smoke-pervious filter rod in which said filter material extends between said smoke-receiving and smoke-discharging ends, and is circumscribed by a smoke impervious wrap means which is exposed to ambient environment;

wherein said filter rod and circumscribing wrap means have a peripheral configuration which is generally cylindrical at said smoke-receiving end, has an intermediate section which tapers on at least two sides towards said smoke-discharging end, and has a generally rectangular shape at said smoke-discharging end.

9. The filtered cigarette according to claim 8 wherein said peripheral configuration at said smoke-discharging end terminates in a lip portion extending radially outward from said two sides.

10. The filtered cigarette according to claim 8 wherein said filter rod is preformed with said peripheral configuration and wherein said wrap means is a plastic film which is extruded over and conforms to the periphery of the filter rod.

11. The filtered cigarette according to claim 8 wherein said wrap means is a smoke-impervious material wrapped about said filter rod and wherein said peripheral configuration is defined in both said filter rod and said wrap means.

12. A cigarette filter in the form of a rod of smoke-pervious material having smoke-receiving and smoke-discharger ends and circumscribed by a smoke-impervious wrap, said rod and said wrap having a peripheral configuration which is generally cylindrical at said smoke-receiving end, has an intermediate section which tapers toward said smoke-discharging end to a reduced size in at least one dimension, and has a further section disposed between said intermediate section and said smoke-discharging end which has a further size in said one dimension which is greater than said reduced size.

13. A cigarette filter according to claim 12 wherein said further section is a lip portion which circumscribes said smoke-discharging end.

14. The cigarette filter according to claim 12 wherein said intermediate section tapers to a reduced size at least at two circumferentially-spaced locations.

* * * * *